US005148654A

United States Patent [19]

Kisters

[11] Patent Number: 5,148,654

[45] Date of Patent: Sep. 22, 1992

[54] PACKAGING SYSTEM

[75] Inventor: Karl Kisters, Kleve, Fed. Rep. of Germany

[73] Assignee: Kisters Maschinenbau GmbH, Kleve, Fed. Rep. of Germany

[21] Appl. No.: 712,159

[22] Filed: Jun. 6, 1991

[30] Foreign Application Priority Data

Jun. 5, 1990 [DE] Fed. Rep. of Germany ..... 4018140

[51] Int. Cl.[5] ..... B65B 11/08

[52] U.S. Cl. ..... 53/462; 53/48.7; 53/209; 53/377.2

[58] Field of Search ..... 53/171, 207, 209, 377.2, 53/377.6, 383.1, 398, 462, 566, 48.7, 48.8, 456

[56] References Cited

U.S. PATENT DOCUMENTS

| | | | |
|---|---|---|---|
| 2,932,929 | 4/1960 | Fahrenbach et al. | 53/209 X |
| 3,016,670 | 1/1962 | Engleson et al. | 53/207 |
| 3,332,207 | 7/1967 | Midnight | 53/207 |
| 3,482,372 | 12/1969 | Hottendorf | 53/462 |
| 3,550,346 | 12/1970 | Hoffmann et al. | 53/377.6 X |
| 3,555,776 | 1/1971 | Nigrelli et al. | 53/209 X |
| 3,908,333 | 9/1975 | Cavanna | 53/209 X |
| 3,955,342 | 5/1976 | Johnson et al. | 53/377.2 |
| 4,571,916 | 2/1986 | Meuwly et al. | 53/209 X |
| 4,727,708 | 3/1988 | Conforto et al. | 53/209 X |
| 4,793,117 | 12/1988 | Raudat et al. | 53/209 X |

FOREIGN PATENT DOCUMENTS

| | | | |
|---|---|---|---|
| 2550258 | 12/1977 | Fed. Rep. of Germany | 53/207 |
| 3515248 | 10/1985 | Fed. Rep. of Germany . | |
| 478026 | 10/1969 | Switzerland . | |
| 1285801 | 8/1972 | United Kingdom | 53/207 |
| 1593653 | 7/1981 | United Kingdom | 53/462 |

OTHER PUBLICATIONS

English-Language brochure entitled "Kisters Wrap-Around Machine Series 300" (Kisters Maschinenbau GmbH).

*Primary Examiner*—Robert L. Spruill
*Assistant Examiner*—Daniel B. Moon
*Attorney, Agent, or Firm*—Herbert Dubno; Andrew Wilford

[57] ABSTRACT

A group of objects is packaged in a package formed of a blank having a base panel, base flaps joined at respective longitudinally extending fold lines to the base panel, a pair of side panels joined at respective transversely extending fold lines to and longitudinally flanking the base panel, and respective pairs of side flaps joined at respective longitudinally extending side fold lines to the side panels. Each pair of side flaps transversely flanks the respective side panel. The blank is advanced longitudinally parallel to the side fold lines to a loading station with the blank horizontal and similarly the group of objects is advanced horizontally and longitudinally to the station and deposited on the base panel there. The side flaps are folded up through about 90° and thereafter the base flaps are folded up through between 45° and 80°. The side panels are then folded up through about 90° and the base flaps are pressed longitudinally against the side flaps and against the group of objects and thereby are adhered together to form a finished package.

16 Claims, 7 Drawing Sheets

PACKAGING SYSTEM

FIELD OF THE INVENTION

The present invention relates to a packaging system. More particularly this invention concerns a method of and apparatus for packaging object in boxes delivered as flat blanks to the packaging apparatus.

BACKGROUND OF THE INVENTION

A standard packaging system of the wrap-around or tray type employs a blank formed with a bottom panel having side edges formed as fold lines from which project side panels and end edges from which project fastening flaps. The side panels each have opposite end edges formed as fold lines from which project further such flaps and one of the side panels can even have another fold line forming another end edge from which projects a top panel having an opposite end edge formed with another flap. Such a blank is a planar piece of cardboard or the like that is stamped to have the desired outline and to give it the panel- and flap-delimiting fold lines.

A standard method for packaging a group of objects in such a blank is described in German patent document 3,515,248 of A. Ghiretti et al (claiming an Italian priority date of Apr. 27, 1984). Here the blank is delivered horizontal to a loading station where one of the side flaps of the blank, which is horizontal, is folded up into a vertical position and the group of objects is moved perpendicular to this upright side panel onto the base panel and is deposited thereon. Then the other side panel is folded up and the flaps are folded in, and the thus formed package is moved off parallel to the first-erected side panel, that is perpendicular to the infeed direction of the objects being packaged. This change in movement direction represents a substantial impediment to operating rapidly as it requires that the objects be brought at least momentarily to a full stop with the time at a stop wasted as well as the time decelerating to it and accelerating away from it. Furthermore special holders must be provided to retain the flaps against the package once they are folded in and until the glue cures, and this extra equipment elevates the cost of the packaging machine.

In U.S. Pat. No. 4,571,916 of M. Meuwly et al the blanks are fed in synchronously and codirectionally to the objects being packaged. Immediately after the objects are deposited on the base panel and while the blank and objects are still moving the front and rear flaps are bent up through 90° and then the side panels are similarly bent up to the vertical position. Thus the device must be provided with special flap- and panel-manipulating devices which must move along on the conveyor with the package to hold everything in place as the glue sets enough to hold the package shut on its own.

Similarly in U.S. Pat. No. 3,844,088 of D. McDonough et al the finished package is transported away in the same direction as that in which the blank is fed to the loading station. Stationary tools are used to fold the side walls up. A special holding station as in above-cited German 3,515,248 holds the package together as its glue is setting up.

Swiss patent 478,026 of P. Engeler describes a multiple-object packaging system wherein the blank is bent up to be U-shaped, with the erected flaps perpendicular to the transport direction. Two special devices are provided for closing the ends of the package, each comprising two narrow-flap folders followed by two wide-panel folders, the latter being movable along with the conveyed package. The packaging apparatus is therefore fairly long and quite complex.

OBJECTS OF THE INVENTION

It is therefore an object of the present invention to provide an improved packaging system.

Another object is the provision of such an improved packaging system which overcomes the above-given disadvantages, that is whose method of operation is fairly simple and whose apparatus is correspondingly small.

A further object is to provide a packaging system which can operate at high speed, that is in number of packages made per unit of time.

SUMMARY OF THE INVENTION

According to the invention a group of objects is packaged in a package formed of a blank having a base panel, base flaps joined at respective longitudinally extending fold lines to the base panel, a pair of side panels joined at respective transversely extending fold lines to and longitudinally flanking the base panel, and respective pairs of side flaps joined at respective longitudinally extending side fold lines to the side panels. Each pair of side flaps transversely flanks the respective side panel. The blank and group of objects are advanced longitudinally parallel to the side fold lines to a loading station with the blank horizontal and the group of objects is deposited on the base panel at the loading station. The side flaps are folded up through about 90° and thereafter the base flaps are folded up through between 45° and 80°, in any case through an angle smaller than that of the side flaps so they remain outside them. The side panels are then folded up through about 90° and the base flaps are pressed longitudinally against the side flaps and against the group of objects and thereby are adhered together to form a finished package.

In contrast to the prior-art systems the blanks and objects being packed are moved synchronously longitudinally with the blanks extending endwise of the transport direction, that is with the ends of the packages formed by the side- and base-panel flaps leading and trailing and the side panels extending parallel to the longitudinal displacement direction. Such orientation greatly simplifies packaging according to the invention. The device can easily produce 60 to 80 packages per minute.

According to this invention glue is applied to outer faces of the base flaps. When making a wrap-around pack rather than a tray pack the blank according to this invention also has a top panel joined at a transversely extending fold line to one of the side flaps, top flaps joined at longitudinally extending fold lines to the top panel and transversely flanking the top panel, and a top/side flap joined at a transversely extending seam to the other of the side flaps. In this case the top/side flap is folded through about 90° down onto the group of objects, the top panel is then folded through about 90° down onto the top/side flap and onto the group of objects to adhere it to the top panel, and the top flaps are folded through about 90° onto the side flaps and onto the group of objects so as to adhere the top flaps to the side flaps. This applies the top flaps over the side flaps, like the base flaps. Of course glue has been provided where necessary on the various flaps prior to pressing them together.

In accordance with this invention each of the finished packages is moved longitudinally off in a row of longitudinally abutting such packages so that the package immediately ahead of and behind each finished package holds the side and base flaps together while the glue sets. The blank and objects are displaced at a predetermined relatively fast speed until the flaps are all pressed together and then are moved at a substantially slower speed to close up the spacing between succeeding packages. The relatively fast speed and the relatively slow speed form a ratio that is substantially equal to the ratio formed between the spacing between leading ends of succeeding groups during the upstream steps and the axial length of the finished products.

The packages are moved downstream of the conveyors that feed the objects and blank in by endless conveyors, including a high-speed upstream stretch that passes through the folding station and a low-speed downstream stretch where the finished packages butt together in a continuous row. The side- and base-flap tools are displaceable synchronously with the objects on the upstream transport stretch and the side-panel tools include stationary bars flanking the upstream transport stretch and having upstream ends below a plane of the blanks and downstream ends well above the plane and transversely spaced more closely than the upstream ends.

When the blank also has a top panel with top/side and top flaps as described above the top-panel folding tool is a stationary bar fixed adjacent the upstream transport stretch and having an upstream end and a downstream end offset transversely inward therefrom. At least some of the tools are vertically and horizontally adjustable.

The blank transporter according to this invention includes an endless conveyor element and a plurality of stops spaced therealong. The upstream conveyor has upstream of the folding station a pair of transversely spaced endless conveyor elements and stiff members transversely bridging same.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
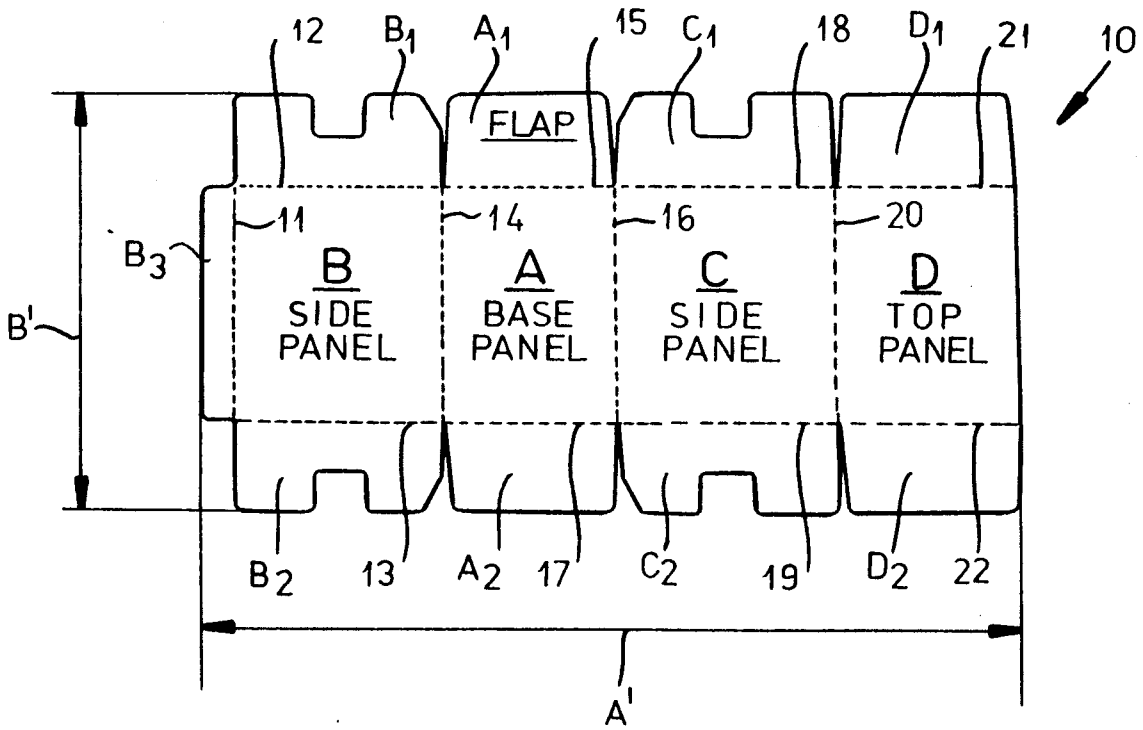
FIG. 1 is a plan view of the box blank according to the invention.

As seen in FIG. 1 a box blank 10 according to this invention has a rectangular base panel A joined at edge seams 14 and 16 to lower edges of identical rectangular side panels B and C. The panel C is joined at an edge fold line 20 to a rectangular top panel D. The side panel B has opposite the edge fold line 14 another edge fold line 11 by means of which it is connected to an edge flap B3 by means of which it is eventually secured to the edge of the top panel D opposite the line 20. The base panel A is joined at end fold lines 15 and 17 to end flaps A1 and A2. Similarly the side panels B and C are joined at respective end lines 12, 13 and 18, 19 to respective end flaps B1, B2 and C1, C2. The top panel D is joined at end fold lines 21 and 22 to end flaps D1 and D2. All the fold lines 12, 15, 18, and 21 are aligned, that is form a straight transversely extending line in the flattened blank, and the fold lines 13, 17, 19, and 22 are similarly aligned. The fold lines 11, 14, 16, and 20 are parallel to each other and perpendicular to the end lines. The blank 10 has an overall length A' and an overall width B'.

Figure 2:
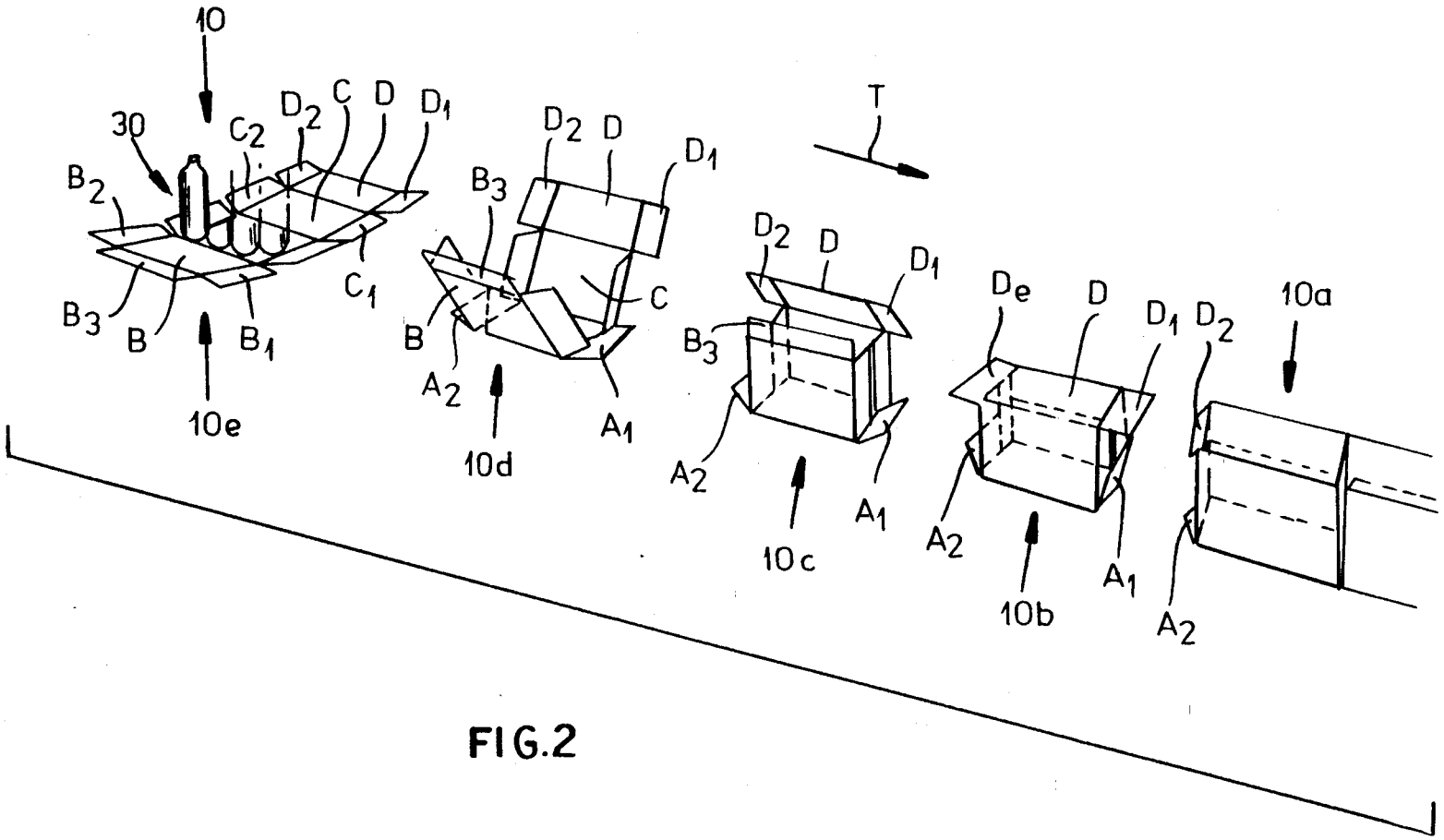
FIG. 2 is a small-scale perspective view illustrating the method of this invention.
Figure 3:
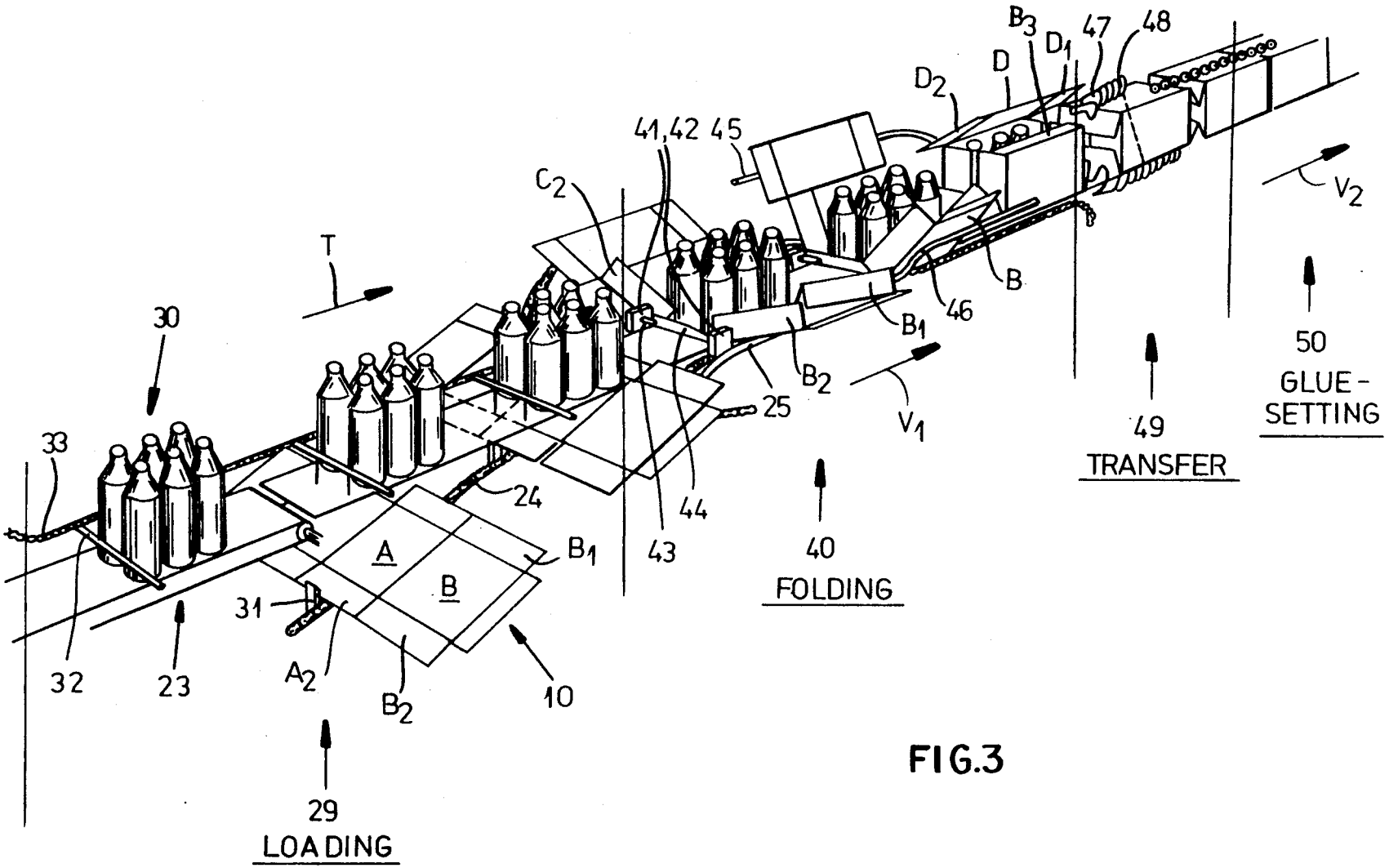
FIG. 3 is a small-scale perspective and partly diagrammatic view illustrating the apparatus of the present invention.
Figure 4:
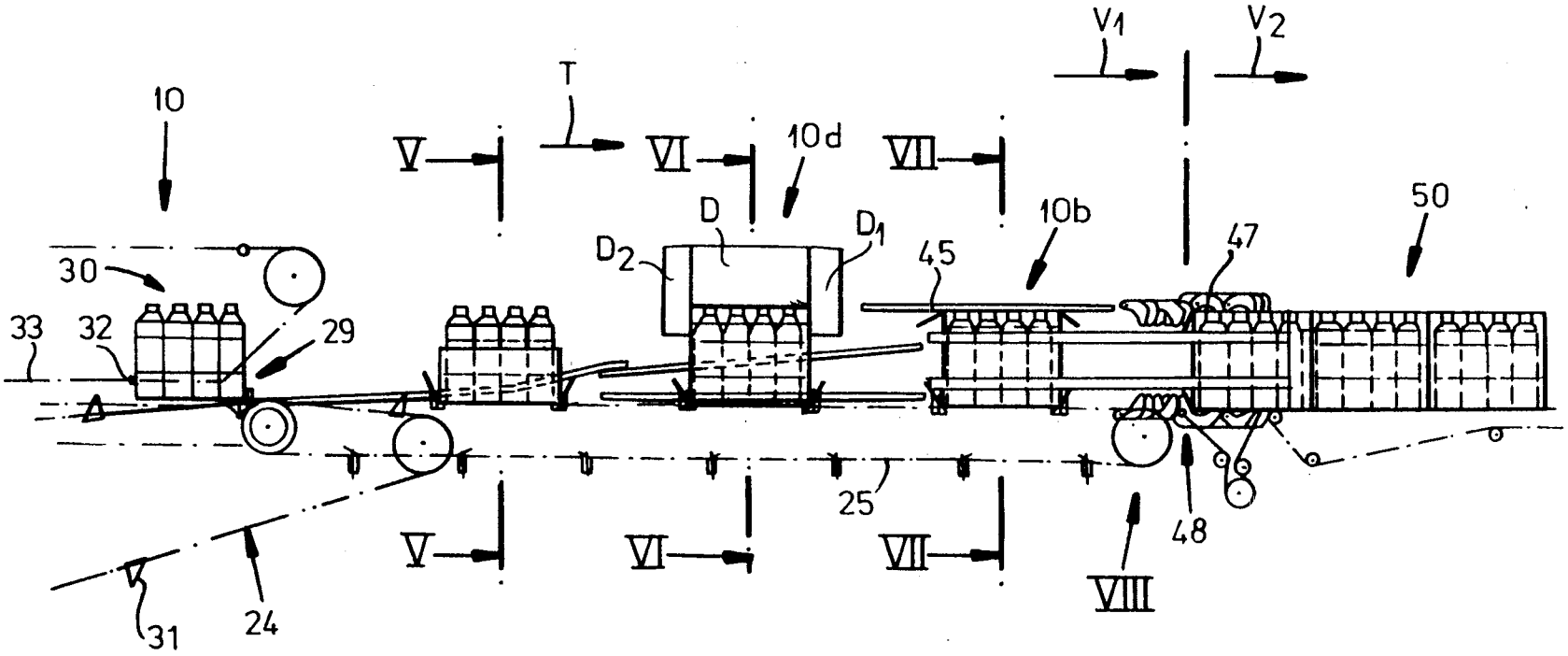
FIG. 4 is a small-scale side view further illustrating the apparatus of this invention.
Figure 5:
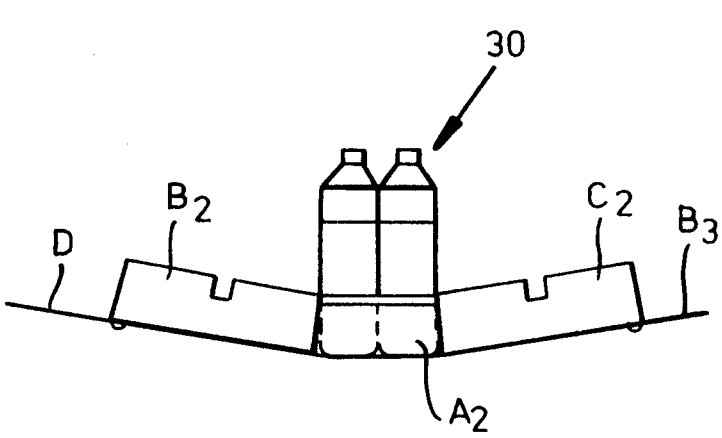
FIGS. 5, 6, and 7 are sections taken respectively along lines V—V, VI—VI, and VII—VII of FIG. 4.
Figure 6:
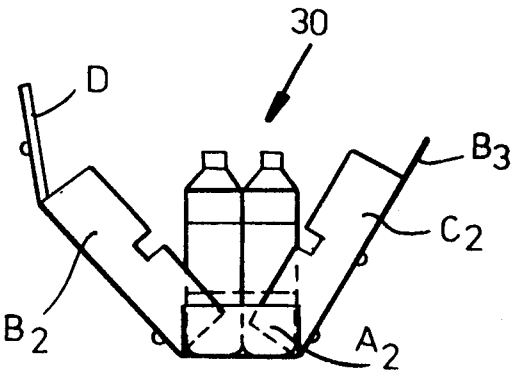
Figure 7:
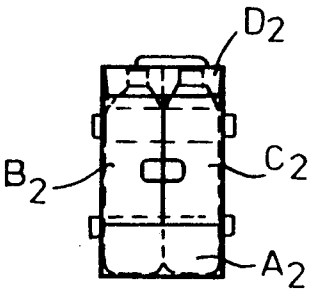
Figure 8:
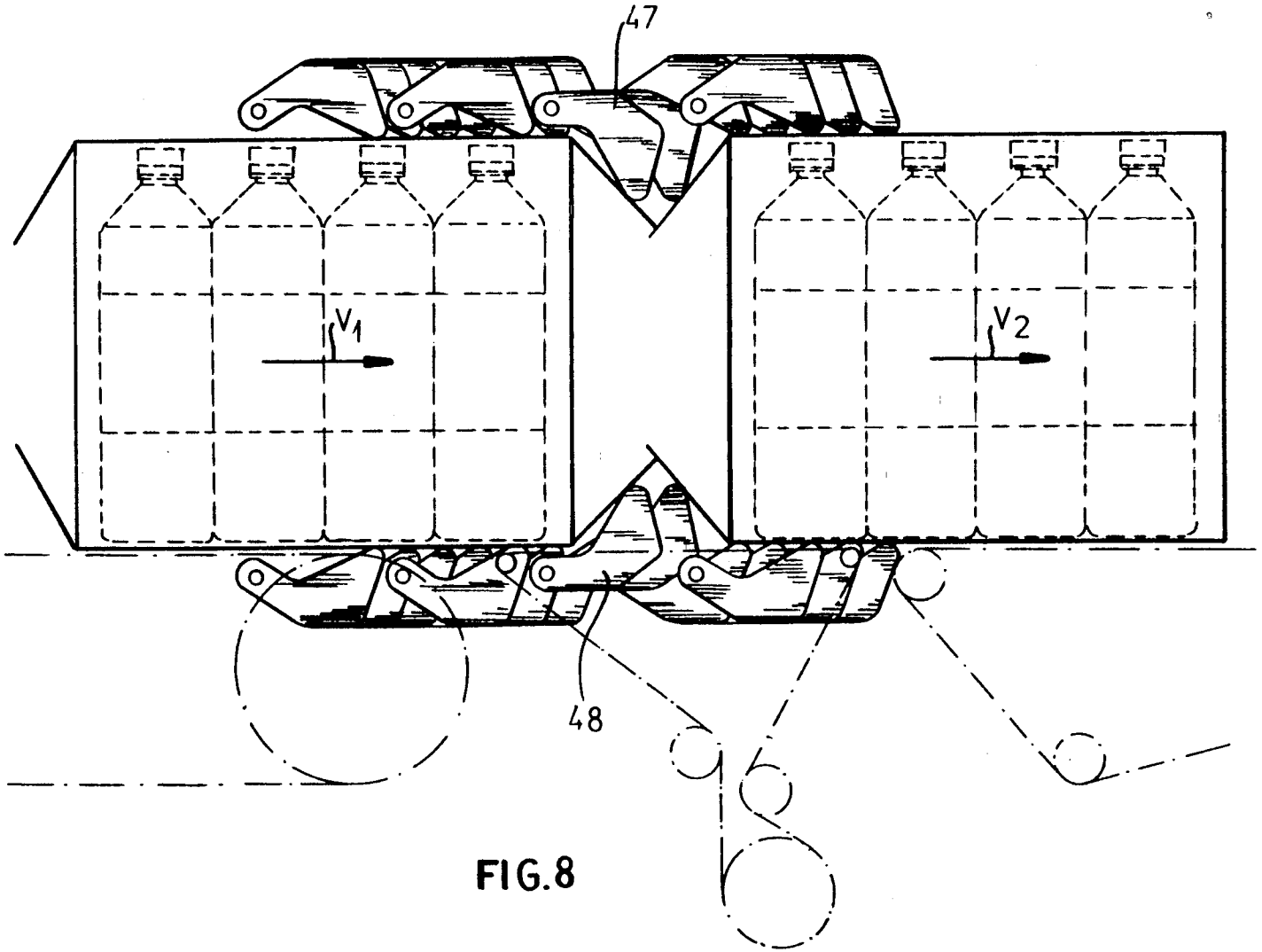
FIG. 8 is a large-scale view of the detail indicated at VIII in FIG. 4.

Such a blank 10 is wrapped as a box around a group 30 of objects, here six bottles, as shown in FIGS. 2 and 4. In this arrangement the blank 10 is moved endwise in transport direction T longitudinally parallel to the edge seams 11, 14, 16, and 20 with the flaps A1, B1, C1, and D1 leading. The flaps B1 and C1 are bent up and the group 30 of objects is deposited on the base panel A, producing the position shown at 10*e*. Then the trailing side flaps B2 and C2 are folded in through about 90° like the leading flaps B1 and C1 and the side panels B and C are folded up to stand perpendicular to the base panel A, leaving the structure as shown at 10*d*.

The end flaps A1 and A2 are then provided with glue by means 70 and folded up through at least 45°, preferably 60°, producing position 10*c*, and the top flap D is similarly glued and folded do over the flap B3, which has been folded in, producing position 10*b*. The package then moves into a longitudinally abutting row of such packages as indicated at 10*a*, so that the end flaps A1, A2, D1, and D2 are pressed in and made to adhere against the flaps B1, B2, C1, and C2.

The apparatus for carrying out the method is shown in FIGS. 3 through 7. It has a loading station 29 where the product group 30 is set on the panel A, a folding station 40, a transfer station 49, and a glue-setting station 50, spaced downstream after each other in the transport direction T. The group 30 is fed in by a conveyor 23 comprised of a pair of chains 33 (only one shown) extending and moving in the direction T and bridged by crossbars 32 that push the groups 30 along. The blank 10 is itself moved by a conveyor chain 24 provided with stops 31 at an upward angle to move underneath the advancing group 30 where both the blank 10 and group 30 are moved by a conveyor belt 25. The belt 25 and the conveyors 24 and 33 all operate at a relatively fast speed $v_1$.

Figure 9:
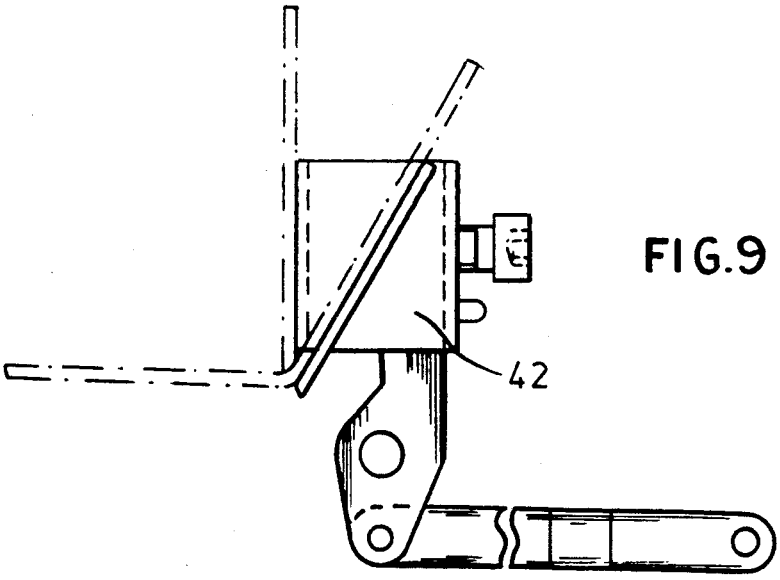
FIGS. 9 and 10 are large-scale views of details of this invention.
Figure 10:
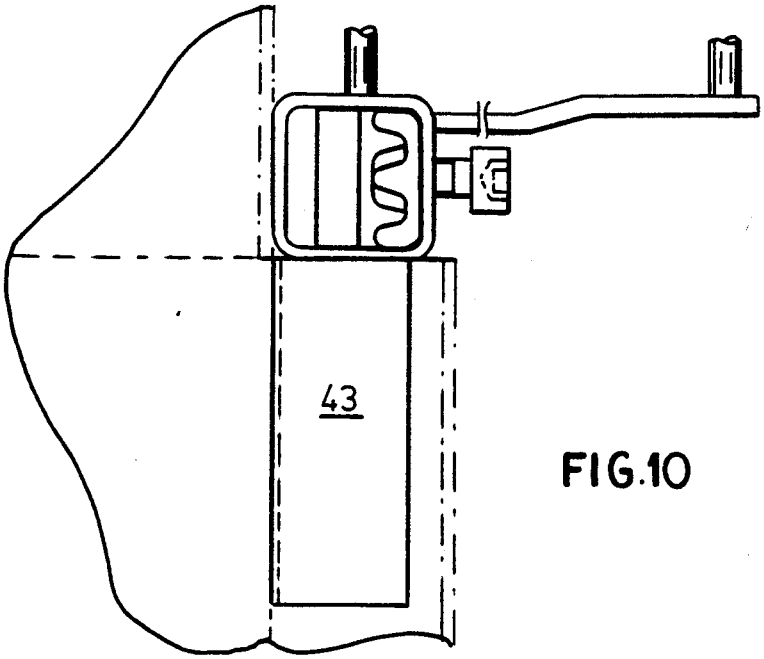

Front and rear jaws 41 and 42 (see FIG. 9) fold in the flaps B1, B2, C1, and C2 and fingers 43 (see FIG. 10) and 44 fold the front and rear lower flaps A1 and A2 through 60°. These tools 41–44 all are carried on a continuous chain device that moves them synchronously with the package being made. Thereafter the blank 10 and group 30 are moved at the relatively fast advance speed $V_1$ between folding bars 46 that fold up the side flaps B and C against the sides of the group 30. Subsequently tools like the tools 41 through 44 first fold in the flap B3 and then, after applying glue to its underside at its outer edge, the top flap D is folded down by another bar 45 like the bars 46. In a similar manner the flaps A1, A2, D1, and D2 have been sprayed with adhesive In the transfer station the lower flaps A1 and A2 are held by spring loaded retaining elements 48 and the upper flaps D1 and D2 are similarly held in place by wedgelike retainers 47 until the thus formed package reaches the output or glue-setting station 50 whose conveyor is moved at a speed $v_2$ that is substantially slower than the speed $v_1$. Thus the succeeding packages butt longitudinally up against each other and hold the end flaps A1—D1 in the front and A2—D2 in the rear closed while the glue sets.

For a package having a longitudinal dimension of 30 cm and a speed $v_2$ of 18 m/min so that 60 packages are made per minute, the speed $v_1$ is equal to 45.72 m/min with a spacing of the packages upstream of the station 50 on center of 46.2 cm. With a spacing measured from the front wall of a package to the rear wall of the preceding package of only 0.762 m and the same 60 packages/minute operating speed and the same speed $v_1$ as cited above, the speed $v_2$ is equal to 12 m/min for a package 20 cm long measured in the direction T.

I claim:

1. A method of packaging a group of objects in a package formed of a blank having a base panel, base flaps joined at respective transversely extending flap-fold lines to the base panel, a pair of side panels joined at respective longitudinally extending panel-fold lines to the base panel and transversely flanking the base panel, and respective pairs of side flaps joined at respective transversely extending side flap-fold lines to the side panels, each pair of side flaps longitudinally flanking the respective side panel, the method comprising the steps of sequentially:

a) advancing the blank longitudinally parallel to the panel-fold lines to a loading station with the blank at least generally horizontal and advancing the group of objects horizontally and longitudinally to the station and depositing the group of objects on the base panel at the loading station;

b) folding up the side flaps through about 90°;

c) folding up the base flaps through between 45° and 80°;

d) folding up the side panels through about 90°; and e) pressing the base flaps longitudinally against the side flaps and against the group of objects and adhering the flaps together to form a finished package.

2. The packaging method defined in claim 1, further comprising the step before step e) of:

d') applying glue to inner faces of the base flaps.

3. The packaging method defined in claim 1 wherein the blank also has a top panel joined at a longitudinally extending panel-fold line to one of the side panels, top flaps joined at transversely extending flap-fold lines to the top panel and longitudinally flanking the top panel, and a top/side flap joined at a longitudinally extending seam to the other of the side flaps, the method further comprising the steps after step d) of sequentially:

d') folding the top/side flap through about 90° down onto the group of objects;

d'') folding the top panel through about 90° down onto the top/side flap and onto the group of objects and thereby adhering the top/side flap and the top panel together; and d''') folding down the top flaps through about 90° onto the side flaps and onto the group of objects and thereby adhering the top flaps to the side flaps to form a finished package.

4. The packaging method defined in claim 2, further comprising after step e) the step of f) moving each of the finished packages longitudinally off in a row of longitudinally abutting such packages, whereby the package immediately ahead of and behind each finished package holds the respective side and base flaps together while the glue sets.

5. The packaging method defined in claim 4, wherein the blank and objects are displaced at a predetermined relatively fast speed during steps a) through e) and then at a substantially slower speed during step f).

6. The packaging method defined in claim 5 wherein the fast speed and the slower speed form a ratio that is substantially equal to a ratio formed between a longitudinal spacing between leading ends of succeeding groups during steps a) through e) and the axial length of the finished products.

7. An apparatus for packaging a group of objects in a package formed of a blank having a base panel, base flaps joined at respective transversely extending flap-fold lines to the base panel and longitudinally flanking the base panel, a pair of side panels joined at respective longitudinally extending panel-fold lines to the base panel and transversely flanking the base panel, and respective pairs of side flaps joined at respective transversely extending side flap-fold lines to the side panels, each pair of side flaps longitudinally flanking the respective side panel, the apparatus comprising:

blank transport means for advancing the blank longitudinally parallel to the longitudinally extending panel-fold lines at a predetermined relatively fast speed to a loading station with the blank at least generally horizontal;

upstream transport means for advancing the group of objects longitudinally at the fast speed to the loading station, for depositing the group of objects on the base panel at the loading station, and for transporting the objects on the base panel downstream from the loading station through a folding station;

means including side-flap tools at the folding station for folding up the side flaps through about 90° and base-flap tools for thereafter folding up the base flaps through between 45° and 80°;

means for applying glue by means 70 to inner faces of the base flaps;

means including side-panel tools at the folding station for folding up the side panels through about 90°; and output transport means for conveying the blanks and objects longitudinally away from the folding station at a predetermined relatively slow speed and for thereby pressing the base flaps longitudinally against the side flaps and against the group of objects to adhere the flaps together to form a finished package.

8. The package apparatus defined in claim 7 wherein the output transport means moves each of the finished packages longitudinally off in a row of longitudinally abutting such packages, whereby the package immediately ahead of and behind each finished package holds the side and base flaps together while the glue sets.

9. The packaging apparatus defined in claim 8 wherein the upstream transport means has at least one endless conveyor element.

10. The packaging apparatus defined in claim 9 wherein the side- and base-flap tools are displaceable synchronously with the objects on the upstream transport means.

11. The packaging apparatus defined in claim 10 wherein the side-panel tools include stationary bars flanking the upstream transport means and having upstream ends below a plane of the blanks and downstream ends well above the plane and transversely spaced more closely than the upstream ends.

12. The packaging apparatus defined in claim 8 wherein the blank also has a top panel joined at a longitudinally extending panel-fold line to one of the side panels, top flaps joined at transversely extending flap-fold lines to the top panel and longitudinally flanking the top panel, and a top/side flap joined at a longitudinally extending seam to the other of the side flaps, the apparatus further comprising:

means including top/side tool for folding the top/side flap through about 90° down onto the group of objects;

means including a top-panel tool for folding the top panel through about 90° down onto the top/side flap and onto the group of objects and thereby adhering the top/side flap and the top panel together; and means including a top-flap tool for folding down the top flaps through about 90° onto the side flaps and onto the group of objects and thereby adhering the top flaps to the side flaps.

13. The packaging apparatus defined in claim 12 wherein the top-panel tool is a stationary bar fixed adjacent the upstream transport means and having an upstream end and a downstream end offset transversely inward therefrom.

14. The packaging apparatus defined in claim 8 wherein at least some of the tools are vertically and horizontally adjustable.

15. The packaging apparatus defined in claim 7 wherein the blank transport means includes an endless conveyor element and a plurality of stops spaced therealong.

16. The packaging apparatus defined in claim 7 wherein the upstream transport means has upstream of the folding station a pair of transversely spaced endless conveyor elements and stiff members transversely bridging same.

* * * * *